US006081963A

United States Patent [19]

Jailor et al.

[11] Patent Number: 6,081,963

[45] **Date of Patent: *Jul. 4, 2000**

[54] NOZZLE LIFT AND ADJUSTMENTMECHANISM FOR AN UPRIGHT VACUUM CLEANER

[75] Inventors: John J. Jailor, Rockford; Brandon L. Mouw, Wyoming, both of Mich.; Scott R. Graham, West Bend, Wis.; Eric R. Metzger, Sand Lake, Mich.

[73] Assignee: BISSELL Homecare, Inc., Grand Rapids, Mich.

[ * ] Notice: This patent is subject to a terminal disclaimer.

[21] Appl. No.: 09/224,685

[22] Filed: Jan. 4, 1999

Related U.S. Application Data

[63] Continuation-in-part of application No. 08/797,573, Feb. 7, 1997, Pat. No. 5,906,024

[60] Provisional application No. 60/011,315, Feb. 8, 1996.

[51] Int. Cl.[7] ..... A47L 5/34

[52] U.S. Cl. ..... 15/368; 15/354; 15/361

[58] Field of Search ..... 15/333, 354, 361, 15/368

[56] References Cited

U.S. PATENT DOCUMENTS

| | | | |
|---|---|---|---|
| 2,734,219 | 2/1956 | Kaufman | 15/361 |
| 3,579,699 | 5/1971 | Balzer | 15/361 |
| 3,683,448 | 8/1972 | Lagerstrom et al. | 15/354 |
| 4,171,554 | 10/1979 | Tschudy | 15/359 |
| 4,376,322 | 3/1983 | Lockhart et al. | 15/323 |
| 4,437,205 | 3/1984 | Koland | 15/354 |
| 4,446,594 | 5/1984 | Watanabe et al. | 15/323 |
| 4,467,495 | 8/1984 | Fish et al. | 15/354 |
| 4,782,552 | 11/1988 | Bartlett et al. | 15/333 |
| 4,823,429 | 4/1989 | Petralia | 15/333 |
| 5,134,750 | 8/1992 | King et al. | 15/333 |
| 5,222,276 | 6/1993 | Glenn, III | 15/333 |
| 5,247,720 | 9/1993 | Sovis et al. | 15/334 |
| 5,255,411 | 10/1993 | Da Costa | 15/333 |
| 5,269,042 | 12/1993 | Stephens et al. | 15/356 |
| 5,351,361 | 10/1994 | Buchtel | 15/334 |
| 5,551,120 | 9/1996 | Cipolla et al. | 15/333 |
| 5,560,074 | 10/1996 | Graham et al. | 15/323 |
| 5,906,024 | 5/1999 | Jailor et al. | 15/354 |

*Primary Examiner*—Theresa T. Snider

*Attorney, Agent, or Firm*—Rader, Fishman, Grauer & McGarry an Office of Rader, Fishman & Grauer PLLC

[57] ABSTRACT

A vacuum cleaner is provided with a wheel housing having at least one axle bracket extending therefrom along a transverse axis and at least one axle bracket-receiving socket formed in a foot of the vacuum cleaner whereby the socket slidably receives and pivotally mounts the at least one axle bracket. The wheel housing is thereby pivotally mounted to the foot. A height adjustment mechanism is provided with the wheel housing having an actuator having a bearing shaft and a bearing sleeve with a longitudinal bore. The longitudinal bore of the bearing sleeve receives the bearing shaft to rotatably mount the actuator. A detent mechanism is provided between the bearing shaft and the bearing sleeve to releasably mount the actuator to the foot. The actuator can be adapted to release upon encountering abnormal forces applied against the vacuum cleaner.

44 Claims, 9 Drawing Sheets

NOZZLE LIFT AND ADJUSTMENTMECHANISM FOR AN UPRIGHT VACUUM CLEANER

CROSS-REFERENCE TO RELATED APPLICATIONS

This application is a continuation-in-part application of U.S. patent application Ser. No. 08/797,573, filed on Feb. 7, 1997 now U.S. Pat. No. 5,906,024, which claims the benefit of U.S. Provisional Application Serial No. 60/011,315, filed on Feb. 8, 1996.

BACKGROUND OF THE INVENTION

1. Field of the Invention

This invention relates to upright vacuum cleaners and, more specifically, to a nozzle lift mechanism for an upright vacuum cleaner which lifts a nozzle from a ground surface when a handle is pivoted to an upright position and which can be incrementally adjusted to position the nozzle at a preselected height from the ground surface during use.

2. Related Art

Vacuum cleaners come in many styles, including an upright type vacuum cleaner which comprise a foot and a pivotably-mounted elongated handle extending upwardly therefrom. The handle is generally grasped by the user to propel the foot over a surface to be cleaned. The foot is often provided with ground-engaging wheels to provide for easier movement over the surface to be cleaned. The foot typically includes an agitator brush rotatably mounted in a forward portion of the base. The agitator brush is typically mounted adjacent a suction inlet in the foot which receives any dirt and debris loosened by the action of the agitator brush. Suction is applied to the inlet and the dirt and debris are then collected in a bag for later disposal.

Vacuum cleaners are often used to clean both bare floors and carpets having varying thicknesses, pile, and shag characteristics. Thus, it is desirable to provide the vacuum cleaner with a height adjustment mechanism which positions the height of the suction inlet and agitator brush relative to the surface to be cleaned so as to dislodge the greatest amount of dirt and debris therefrom. Examples of prior art height adjustment mechanisms are disclosed in U.S. Pat. No. 4,467,495 (Fish et al.), U.S. Pat. No. 4,437,205 (Koland), U.S. Pat. No. 3,683,448 (Lagerstrom et al.), and U.S. Pat. No. 4,171,554 (Tschudy).

Further, it is also desirable to provide a vacuum cleaner with a nozzle lift mechanism which raises the suction inlet and agitator brush from the surface to be cleaned when the handle is pivoted to a non-use position, often generally vertical, to prevent damage to the surface when the agitator brush continues to rotate. Examples of prior art nozzle lift mechanisms are disclosed in U.S. Pat. No. 3,579,699 (Balzer), U.S. Pat. No. 4,782,552 (Bartlett et al.), U.S. Pat. No. 5,269,042 (Stephens et al.), U.S. Pat. No. 5,255,411 (Da Costa), U.S. Pat. No. 4,446,594 (Watanabe et al.) and U.S. Pat. No. 5,222,276 (Glenn III).

The height adjustment mechanism and nozzle lift mechanism must typically work in conjunction to prevent either mechanism from prohibiting the other from working properly. For example, the height adjustment mechanism must not lock the suction inlet and agitator brush at a particular height because the handle may be pivoted to the non-use position and actuate the nozzle lift mechanism to raise the suction inlet and agitator brush from the surface to be cleaned. If the height adjustment mechanism locks the suction inlet and agitator brush at a particular height, damage can occur to either or both of these mechanisms during use.

Prior art nozzle lift mechanisms and height adjustment mechanisms often require several parts and complicated assembly steps to install them in a base of a vacuum cleaner. A large number of parts and additional assembly steps can add to the manufacturing cost of a typical vacuum cleaner.

Other objects, features, and advantages of the invention will be apparent from the ensuing description in conjunction with the accompanying drawings.

SUMMARY OF THE INVENTION

In accordance with the present invention, a vacuum cleaner has a height adjustment mechanism to conveniently adjust the height of a suction inlet and agitator brush relative to a surface and to lift the suction inlet from proximity with the surface only when a handle is pivoted to a non-use position.

The invention relates to a vacuum cleaner comprising a foot, a handle pivotally mounted to the foot between a stored and a use position, and a vacuum motor mounted to one of the handle and the foot. The foot has a suction inlet fluidly connected to the vacuum motor, an agitator brush rotatably mounted thereto, and a wheel assembly pivotally mounted to a forward portion of the foot for rotation about a transverse axis. The wheel assembly is preferably adapted to rollably support the vacuum cleaner on a floor surface and comprises a wheel housing, an axle mounted to the wheel housing and at least one wheel rotatably mounted to the axle. A height adjustment mechanism is mounted to the foot and is operably connected to the wheel housing and adapted to move the wheel housing between a first and a second height positions relative to the foot thereby adjusting the position of the agitator brush relative to the floor.

In one aspect, the invention relates to the wheel housing having at least one axle bracket extending therefrom along the transverse axis and at least one axle bracket-receiving socket formed in the foot, slidably receiving and pivotally mounting the at least one axle bracket so that the wheel housing is pivotally mounted to the foot.

The at least one axle bracket can be integrally formed with the wheel housing. The at least one axle bracket can be U-shaped in cross section. The at least one axle bracket can comprise a plurality of axle brackets. The plurality of axle brackets can comprise alternating upwardly-directed U-shaped members and downwardly-directed U-shaped members. There can be at least one axle bracket-receiving socket on the foot for each of the plurality of axle brackets.

A stop member can be mounted to the foot adjacent to the wheel housing to prevent lateral movement of the wheel housing with respect to the foot. The stop member can be aligned with the transverse axis to prevent lateral movement and withdrawal of the at least one axle bracket with respect to the at least one axle bracket-receiving socket. The stop member can comprise a resilient finger mounted to the foot movable between a first position wherein the finger obstructs the lateral movement of the at least one axle bracket with respect to the at least one axle bracket-receiving socket and a second position wherein the lateral movement of at least one axle bracket with respect to the at least one socket is unobstructed by the finger whereby the wheel housing can be mounted to the foot only when the finger is located in the second position. The wheel housing can be movable between an install position and an operative position, wherein in the install position the at least one axle bracket can be slidably moved with respect to the at least one socket and in the operative position the stop member is positioned to prevent lateral movement of the wheel housing with respect to the foot.

The wheel housing can have an underside portion with a transverse groove, the transverse groove can have at least one detent and receives the axle, wherein the detent retains the axle within the transverse groove.

The height adjustment mechanism can comprise an actuator movably mounted to the foot and adapted to be moved between a first setting and a second setting, and a cam mounted to the actuator and in abutment with the wheel assembly so that movement imparted to the actuator is transmitted to the wheel assembly via the cam whereby movement of the actuator selectively positions the foot a preselected distance from the floor surface. The cam can have a radial edge which abuts the wheel assembly. The actuator can comprise a sector-shaped member rotatably mounted to the foot for movement about a horizontal axis. The actuator can have an outer radial surface which includes several shallow indentations thereon whereby the indentations aid a user in grasping the actuator for actuation thereof.

The height adjustment assembly can further comprise a shaft having a first end mounted to the actuator and a second end mounted to the cam. The shaft can have a generally rectangular cross section with a pair of opposed arcuate surfaces and a pair of opposed flat surfaces. The foot can further comprise a retainer having a generally circular journal and a slot whereby the opposed arcuate surfaces are sized to rotate within the journal and the opposed flat surfaces are sized to fit within the slot for assembly of the shaft to the retainer.

In another and an additional aspect, the invention relates to the actuator having a bearing shaft, the foot comprising a bearing sleeve with a longitudinal bore which receives the bearing shaft for rotation about a longitudinal axis and a detent mechanism between the bearing shaft and the bearing sleeve to releasably mount the actuator to the foot.

The detent mechanism can comprise at least one spring arm mounted to the bearing shaft and having a lateral shoulder which can be received beneath a retaining surface of the foot. The lateral shoulder can have a leading surface extending outwardly from an end of the at least one spring arm at a first acute angle with respect to the longitudinal axis of the actuator to assist in installing the actuator in the foot and a retaining surface extending inwardly from an upper end of the leading surface at a second acute angle with respect to the longitudinal axis for releasable retention of the actuator in the foot. The detent mechanism can be constructed to retain the actuator to the foot under normal operating conditions and preferably is adapted to release the actuator from the foot when a downward force of a predetermined magnitude is applied to the foot and an upward force is applied to the actuator.

A retainer can be pivotally mounted to the foot which is provided with a movable ridge thereon. The handle assembly can have a first protrusion and a second protrusion in register with the ridge at different positions of the handle assembly relative to the foot to releasably retain the handle assembly at predetermined positions relative to the foot. The retainer can further comprise a spring arm which biases the movable ridge into contact with the handle assembly. The first protrusion on the vacuum motor housing can comprise a generally right triangular shape. The second protrusion can be adapted to retain the handle assembly at approximately a 45 degree angle with respect to vertical.

BRIEF DESCRIPTION OF THE DRAWINGS

The invention will now be described with reference to the drawings wherein.

DESCRIPTION OF THE PREFERRED EMBODIMENTS

Figure 1:
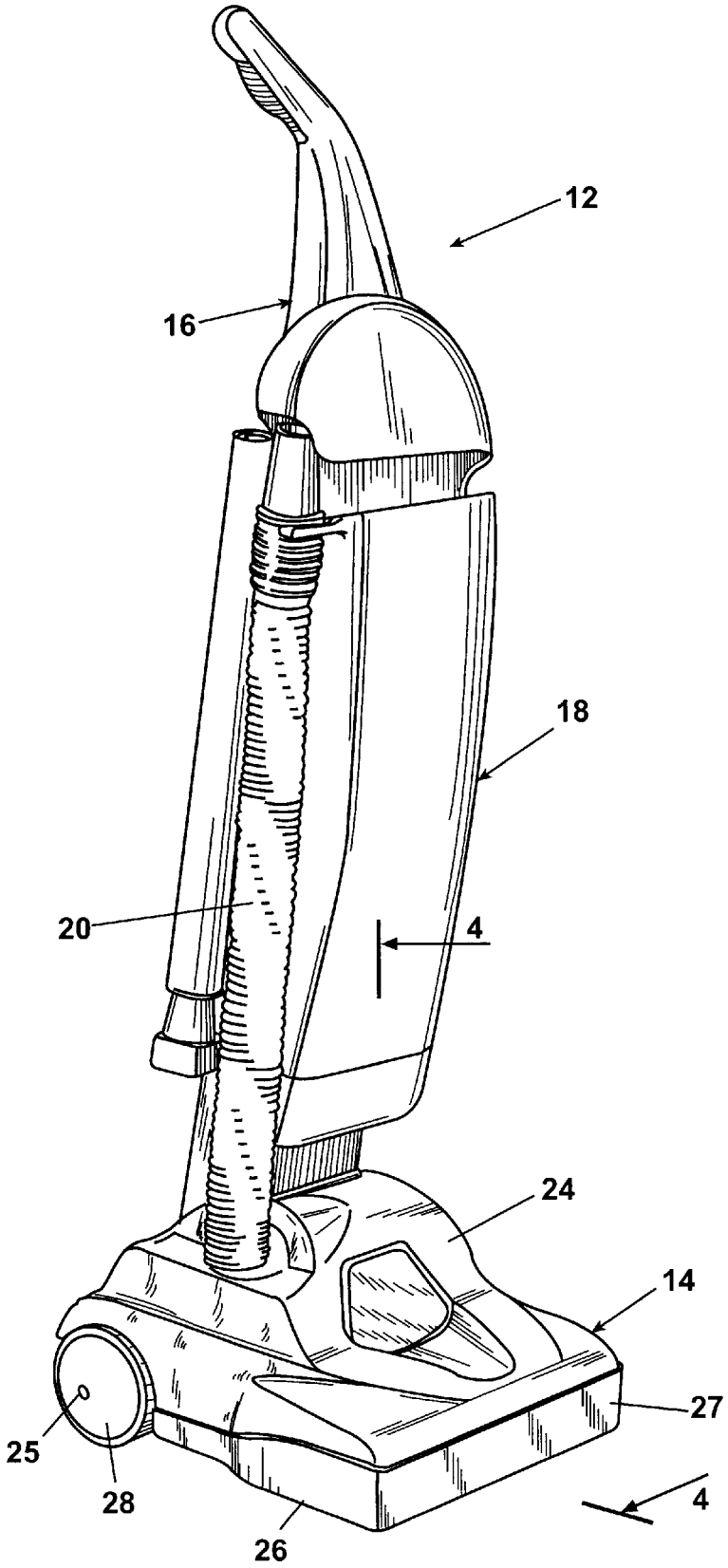
FIG. 1 is a front perspective view of an upright vacuum cleaner according to the invention.

Referring now to the drawings and to FIGS. 1–4 in particular, an upright vacuum cleaner 12 according to the invention is shown. The vacuum cleaner 12 comprises a floor engaging foot 14, a handle assembly 16 pivotally mounted to and extending upwardly from the foot 14, a bag housing 18 provided on the handle assembly 16 and a flexible hose 20 extending upwardly from the foot 14.

The foot 14 comprises a cover 24 which is mounted to a base pan 26, a pair of rear wheels 28 supported by pins 25 are provided on the rear of the base pan 26 for rollably supporting the rear of the vacuum cleaner 12. An elastomeric bumper 27 is mounted to a perimetrical surface of the foot 14 by a conventional method. The foot 14 further includes a downwardly-facing suction inlet 75 which includes a rotary agitator brush 68 therein. A pair of lift wheels 30 at a central portion of the base pan 26 are adapted to lift the front of the foot 14 away from the floor when the handle 16 is moved to an upright position. The lift wheels 30 serve the dual purpose of raising the agitator brush 68 thereby preventing damage to the carpet and to provide a mechanism for manually adjusting the operating height of the suction inlet 75 and agitator brush 68.

Figure 3:
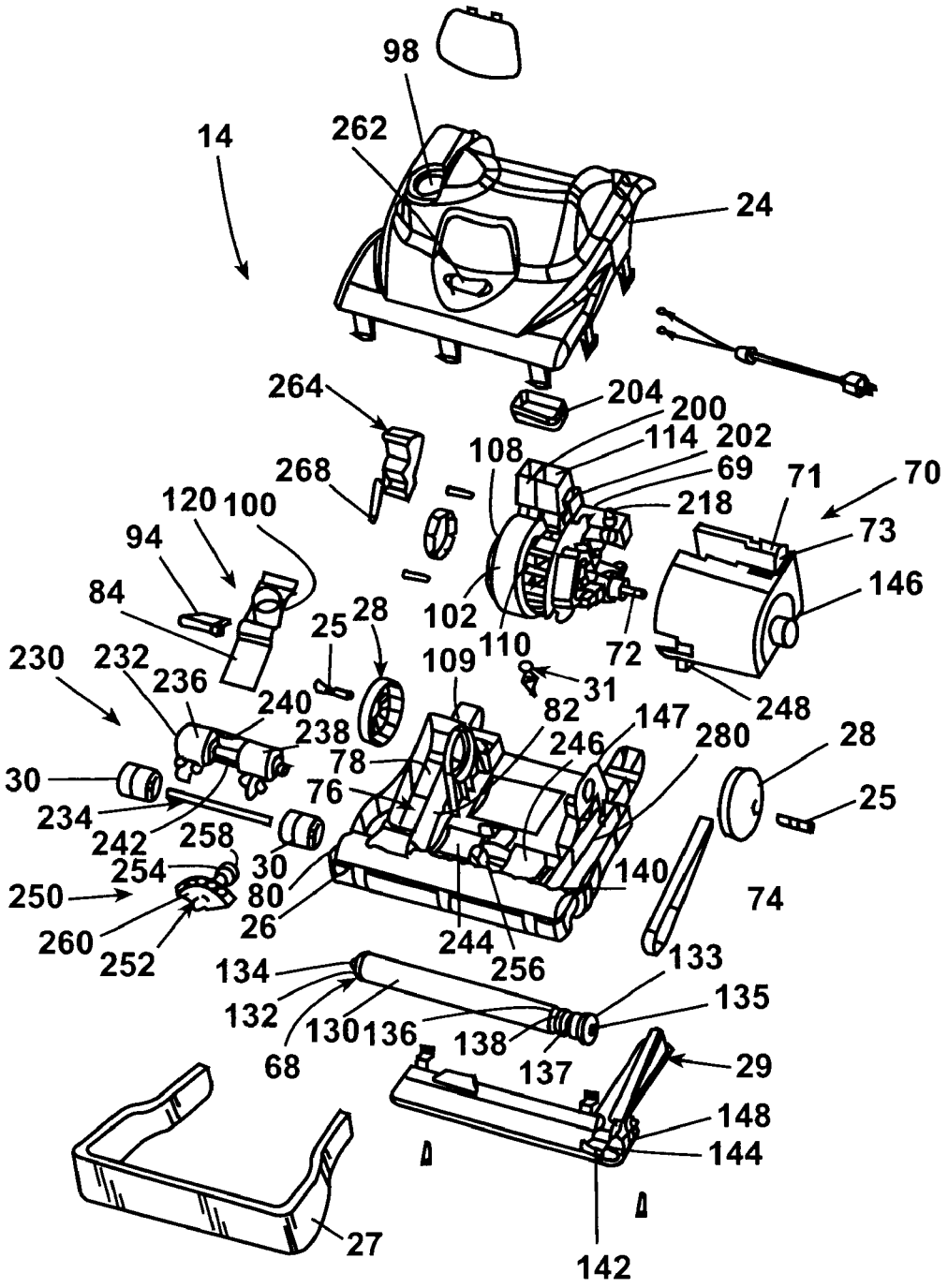
FIG. 3 is an exploded view of a lower portion of the upright vacuum cleaner of FIG. 1.
Figure 4:
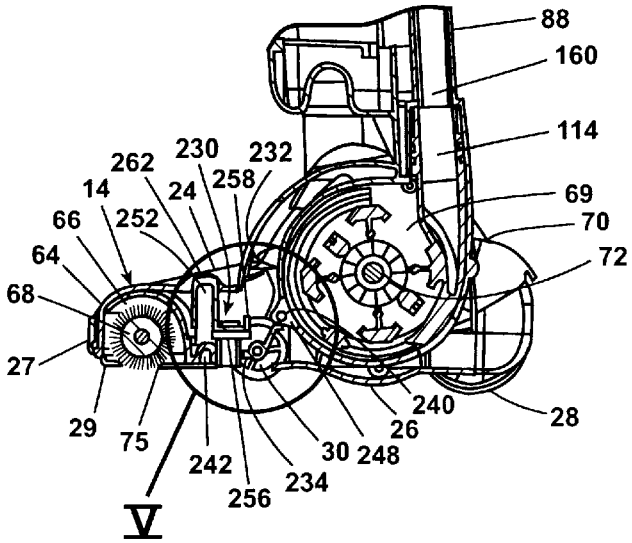
FIG. 4 is a fragmentary cross-sectional view of the upright vacuum cleaner of FIG. 1, taken along lines 4—4 of FIG. 1.

Referring now to FIGS. 3 and 4, a vacuum motor 69 is mounted inside a vacuum motor housing 70 which is rotatably mounted to the base pan 26. An upper surface of the vacuum motor housing 70 includes a pair of upwardly-extending rectangular flanges 71 and 73 disposed at a right angle with respect to each other and located adjacent a vacuum motor power toggle switch 218. A circular boss 108 extends from an impeller end 102 of the vacuum motor housing 70 and a second circular boss 146 extends from the other end of the vacuum motor housing 70. The boss 108 is inserted within an upwardly-extending circular retainer bracket 109 on the base pan 26 and the boss 146 is then urged downwardly and an end portion of the boss 146 is snapped into a slotted circular retainer bracket 147 extending upwardly from base pan 26. An inner portion of the boss 146, the circular bosses 108, 146 and retention brackets 109, 147 cooperate to pivotally secure the motor housing 70 to the base pan 26 as more fully disclosed in U.S. Pat. No. 5,511,282 entitled Motor Mounting Arrangement and Method for a Vacuum Cleaner, filed Apr. 13, 1995, which is incorporated herein by reference. A downward-facing rib (not shown) on the cover 24 is positioned outwardly of the retainer bracket 147 to prevent the vacuum motor 69 from coming out of engagement with the retainer bracket 147 when the cover 24 is assembled onto the base pan 26.

As shown in FIGS. 3 and 4, an intermediate wall 64 of the base pan 26 forms a agitator chamber 66 in which the agitator brush 68 is rotatably mounted. The suction inlet 75 is provided in the agitator chamber 66 for conventional on-the-floor cleaning. The agitator brush 68 comprises a cylindrical body 130 having first and second bearings 132 and 133, respectively, at each end. Each bearing 132 and 133 includes an axially-extending projection 134 and 135, respectively. The cylindrical body 130 includes first and second axially-spaced transverse grooves 136 and 137 adjacent the second bearing 133 and has a crowned belt-receiving portion 138 between the grooves 136, 137. To assemble the agitator brush 68 into the foot 14, a motor shaft 72 of the vacuum motor 69 extends from one end of the housing 70 and receives a drive belt 74. The belt 74 extends forwardly to capture the belt-receiving flange 138 of the agitator brush 68 to rotatably drive the agitator brush 68. The base pan 26 includes a first socket (not shown) into which the projection 134 on the bearing 132 is inserted. The projection 135 on the second bearing 133 is inserted into a vertical slot 140 in the base pan 26 and is retained therein by the bearing 148 on the sole plate 29 when the sole plate 29 is mounted to the base pan 26. The sole plate 29 has flanges 142 and 144 which are semi-circular in configuration and form annular baffles therein. Similar semi-circular flanges are located on the base pan 26 in complementary relationship to the flanges 142 and 144. When the sole plate 29 is mounted to the base pan 26, the flanges 142 and 144 form annular baffles which are positioned in the first and second grooves 136 and 137 to prevent debris from entering the belt-receiving area 138. Preferably, the vacuum motor housing 70 and base pan 26 are designed such that the vacuum motor housing 70 rotates about the axis of rotation of the shaft 72 and the bosses 108, 146 are concentrically aligned with the axis of the shaft 72.

An impeller fan 110 is operably coupled to the motor 69 and is in the impeller end 102 of housing 70. The impeller fan 110 is received in a conventional volute chamber 112 of the vacuum motor housing 70. The volute chamber 112 terminates in an outlet conduit 114 which is integrally formed with the vacuum motor housing 70 and extends outwardly therefrom. A resilient motor output gasket 204 is fitted over the outlet conduit 114. The output gasket 204 is snugly inserted over the outlet conduit 114 and is further matingly received within an inlet tube 160 of the handle assembly 16 in order to provide a sealed fit between the outlet conduit 114 of the vacuum motor housing 70 and the handle assembly 16. The outlet conduit 114 of the vacuum motor housing 70 is then securely mounted to the base portion of the handle assembly 16 by a conventional fastener 208 to permit the handle assembly 16 to rotate with the motor housing 70, with respect to the base pan 26 about the axis of rotation of the motor shaft 72.

A working air conduit 76 is formed in the base pan 26 by a bottom wall 78 and a pair of upstanding side walls 80 and 82. The conduit 76 is closed on the top by a cover plate 84 which mounts a diverter valve 94. The diverter valve 94 is sealed to the side walls 80 and 82 and the bottom wall 78 by a shoulder (not shown) which is in contact with the side walls 80 and 82 during movement of the handle assembly 16 between an upright position and a reclining position. The working air conduit 76 extends rearwardly from one end of the agitator chamber 66 to the impeller fan opening 110 thereby fluidly connecting the agitator chamber 66 and the impeller fan 110. A flexible hose mount 100 is integrally formed in the cover plate 84 and mounts the lower end of the flexible hose 20. The hose mount 100 is in registry with hose opening 98 in cover 24. Conventional fasteners such as adhesives can be used to secure the lower end of the hose 20 to the mount 100.

As shown in FIG. 3, the convertible upright vacuum cleaner 12 according to the invention incorporates a conversion valve assembly 120, described in U.S. Pat. No. 5,560,074 issued Oct. 1, 1996 and incorporated herein by reference, to selectively direct the suction generated by the impeller fan between either the agitator chamber 66 or the flexible hose 20 depending upon the position of the handle 16 relative to the foot 14. The diverter valve 94 is controlled by the handle 16 to shut off the flow of air from the brush roll chamber 68 or the flexible hose in a manner described in U.S. Pat. No. 5,560,074. With the handle 16 received in the upright position as seen in FIG. 1, the diverter valve assembly 94 is pivoted to establish fluid flow communication between the flexible hose 20 and the volute chamber 112 and block fluid flow communication between the agitator chamber 66 and the volute chamber 112. Therefore, all of the suction generated by the rotation of the impeller fan 110 is directed solely to the flexible hose 20 for above-the-floor cleaning when the handle assembly 16 is in the upright position as shown in FIG. 1.

According to the invention, the upright vacuum cleaner 12 also includes a lift assembly 230 which automatically lifts the agitator chamber 66 from contact with the floor being cleaned when the handle assembly 16 is pivoted from a rearwardly tilted use position to the upright storage position shown in FIG. 1.

Figure 5:
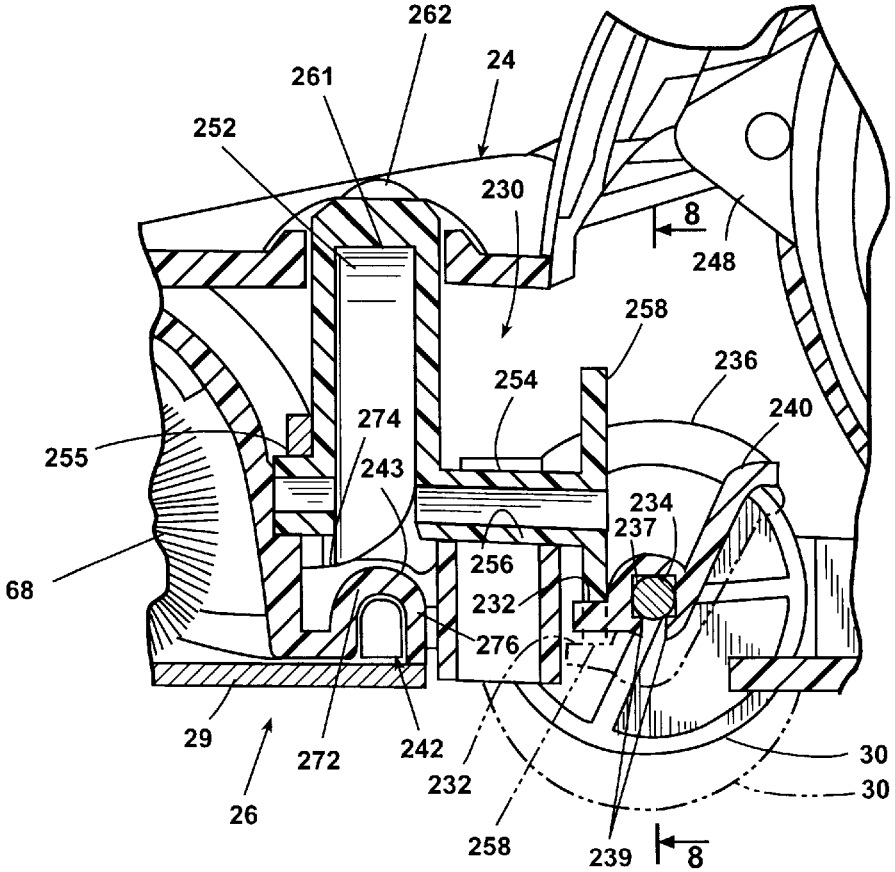
FIG. 5 shows cross-sectional view of the vacuum cleaner of FIG. 1, enlarging the encircled region marked V of FIG. 4.

A first embodiment of the lift assembly 230 is shown in FIGS. 3–5 and in greater detail in FIGS. 6–11 and 15. The lift assembly 230 comprises a housing 232, axle 234 and lift wheels 30. The housing 232 comprises a pair of semi-cylindrical shells 236 and 238 connected at a central portion thereof by a flange 240. Each of the shells 236 and 238 forms a wheel well for a corresponding lift wheel 30.

Figure 15:
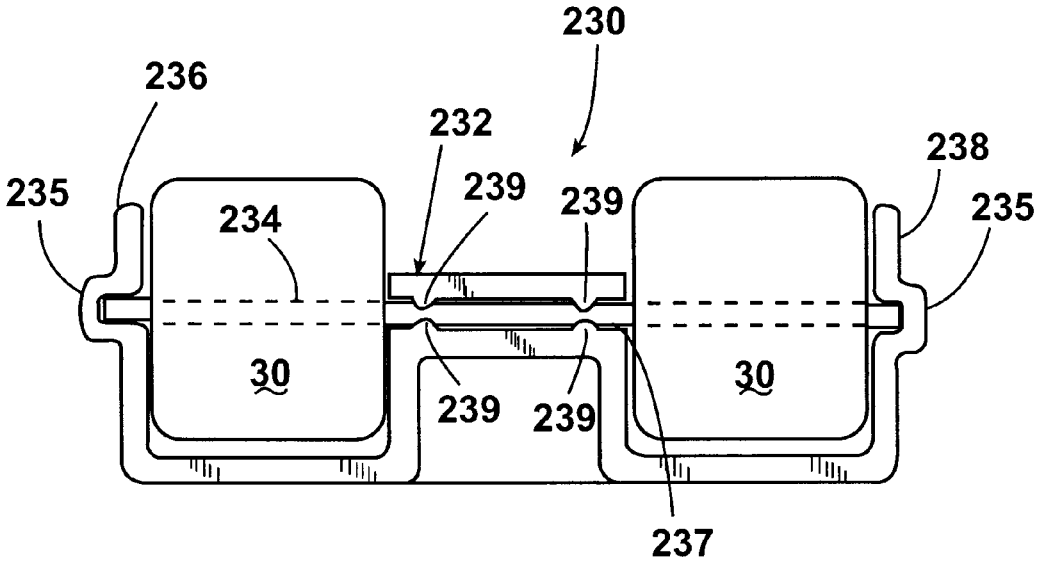
FIG. 15 is a bottom plan view of the wheel housing assembly.

As shown in FIG. 15, each of the shells 236 and 238 is formed with a hub 235 at an outer axial end thereof. Each hub 235 defines an interior socket adapted to receive an end of the axle 234. The central flange 240 of the housing 232 is provided with a transversely extending groove 237 which preferably extends from the shell 236 to the shell 238 and is provided with a depth sufficient to receive the axle 234. The groove 237 is provided with a plurality of detents 239 located adjacent a surface of the flange 240.

The detents 239 retain the axle 234 when it is press-fit within the groove 237. The axle 234 is thereby mounted to the housing 232 by sliding the lift wheels 30 on each end thereof, aligning the ends of the axle 234 with the hubs 235 and the lift wheels 30 with the corresponding wheel well of the shells 236 and 238, and press fitting an intermediate portion of the axle 234 within the groove 237. The walls of the groove 237 resiliently deform when the axle is first urged against them, but then spring back to their undeformed state when the axle 234 passes thereover. The detents 239 thereby retain the axle 234 within the groove 237 and the lift wheels are free to rotate within their corresponding wheel wells of the shells 236 and 238.

Turning to FIGS. 3–7 and 10–11, a forward edge of the housing 232 includes a plurality of flanges 242 extending therefrom. Each flange 242 is provided with a U-shaped retainer bracket 243 extending laterally therefrom so that the flange 242 and bracket 243 cooperate to form an L-shaped member adapted to be received by the base pan 26 to pivotally mount the housing 232 thereto. As can be best seen in FIG. 6, the housing 232 is shown having four flanges 242 with brackets 243 which alternate in orientation from an upwardly-opening U-shaped member to a downwardly-opening U-shaped member. Preferably, the brackets 243 are axially aligned in the transverse orientation to define an axis of rotation 245 for the housing 232. Additional or fewer flanges can be provided to the housing 232 without departing from the scope of this invention.

Figure 6:
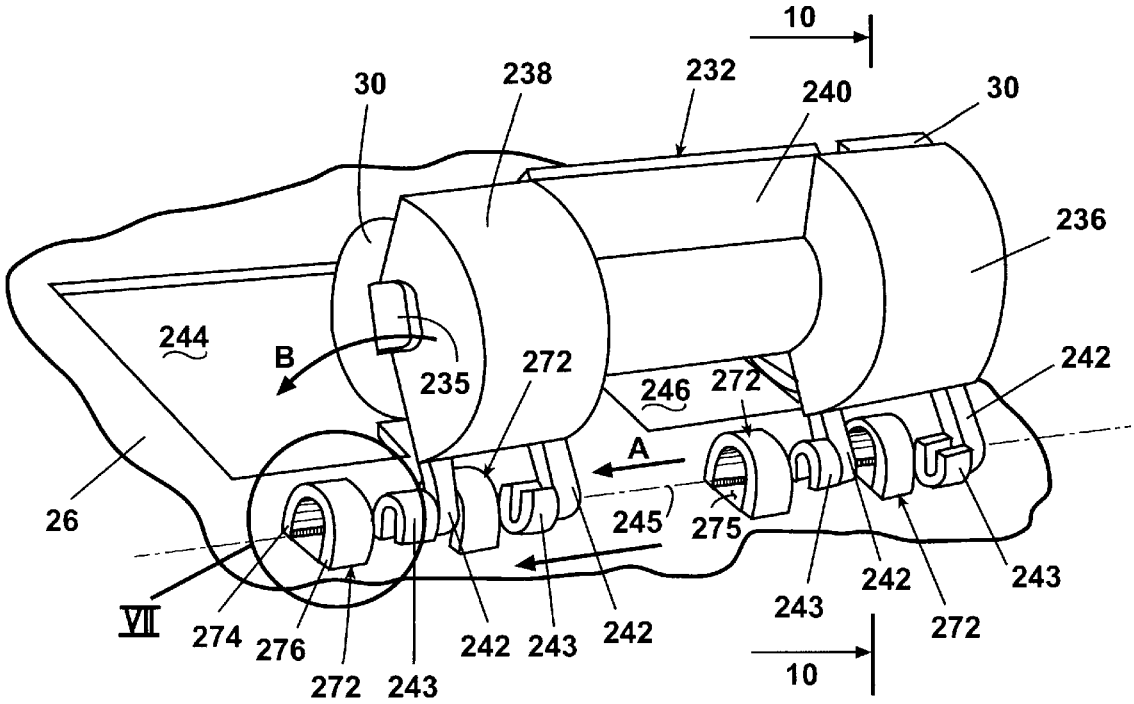
FIG. 6 is a fragmentary perspective view of a wheel housing for a height adjustment mechanism of the above vacuum cleaner of FIG. 1, illustrating the process of mounting the height adjustment mechanism onto a base of the upright vacuum cleaner.
Figure 7:
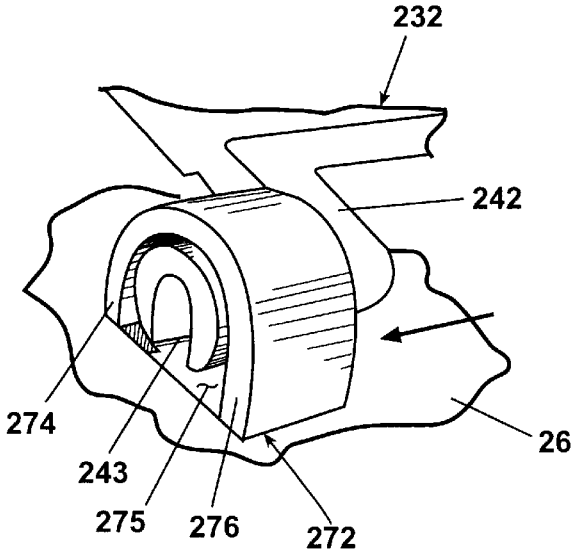
FIG. 7 is a fragmentary perspective view of one of the brackets on the wheel housing of FIG. 6, illustrating the mounted bracket on the base of the upright vacuum cleaner.

As shown in FIGS. 3–5 and in greater detail in FIGS. 6–7, the base pan 26 includes a pair of spaced apertures 244 and 246 in a floor portion thereof which are adapted to receive a lift wheel 30 of the lift assembly 230 when the housing 232 is pivotally mounted to the base pan 26. A plurality of inverted U-shaped mounts 272 are formed adjacent a forward edge of each of the apertures 244 and 246 which extend upwardly from the floor portion of the base pan 26 adjacent the agitator chamber 66. Each of the U-shaped mounts 272 has a rearward leg 274 and a forward leg 276. The U-shaped mounts 272 each define an interior portion 275 between the legs 274 and 276. The interior portions 275 of each of the mounts 272 are aligned with the axis of rotation 245.

The housing 232 is assembled to the base pan 26 by positioning the housing 232 in a generally vertical orientation so that the brackets 243 are located along the axis of rotation adjacent a corresponding U-shaped mount 272 as shown generally in the position of FIG. 6. The housing 232 is then slid transversely in the direction of arrow "A" of FIG. 6 in order to slidably insert each bracket 243 of the flanges 242 into a corresponding interior portion 275 of the U-shaped mounts 272. The housing 232 is then pivoted in the direction of arrow "B" of FIG. 6 to locate the lift wheels 30 within a corresponding aperture 244, 246. The housing 232 is thereby pivotally mounted to the base pan 26 by the location of the brackets 243 within the mounts 272 as best shown in FIG. 7.

When the housing 232 is so positioned, one of the hubs 235 is located directly adjacent to a tab 222 on the base pan 26 which prevents transverse motion of the housing 232 in a direction opposite to arrow "A". Thus, the tab 222 acts as a stop member to prevent the brackets 243 from being disengaged from the mounts 272 when the housing 232 is pivotally mounted to the base pan 26. Removal of the housing 232 from the base pan 26 can be accomplished by pivoting the housing 232 in a direction opposite to arrow "B" in FIG. 6 until the housing 232 is clear of the tab 222 and then moving the housing 232 in a direction opposite to arrow "A".

As illustrated in FIGS. 4–5, the motor housing 70 includes an outwardly extending protrusion 248 along its forward surface which is radially aligned with the central flange 240. As the vacuum cleaner handle assembly 16 is rotated from a rearwardly tilted position to an upright position as shown in FIG. 1, the motor housing 70 rotates with the handle assembly 16. The outwardly-extending protrusion 248 on the surface of the rotating motor housing 70 contacts the wheel housing 232 at central flange 240 as the handle assembly 16 nears the upright stored position. The protrusion 248 forces the wheel housing 70 to pivot downwardly with respect to the base pan 26 to thereby raise the forward end of the foot 14 with respect to the floor surface.

The raising of foot 14 lifts the agitator brush 68 from contact with the floor surface. This raising of the agitator brush 68 prevents damage to the floor surface if the vacuum cleaner is left stationary for an extended period of time. Conversely, the lowering of the handle assembly 16 from the upright stored position removes the abutment of the protrusion 248 against the central flange 240 and permits the housing 232 to pivot to its previous position whereby the agitator brush 68 is located adjacent the floor surface.

Again turning to FIGS. 3–5, the upright vacuum cleaner 12 also includes a first embodiment of a manual height adjustment mechanism 250 which permits a user to selectively position the height of the agitator brush 68 relative to the floor surface for cleaning various types of floor surfaces, i.e., shag carpet, short pile carpet, bare floors, etc. It will be understood that the height adjustment mechanism is effective only when the handle assembly 16 is located in a lower floor cleaning mode. As described above, the protrusion 248 on the motor housing 70 lowers the lift assembly 230 to its fullest extent when the handle assembly 16 is located in the upright stored position.

Figure 8:
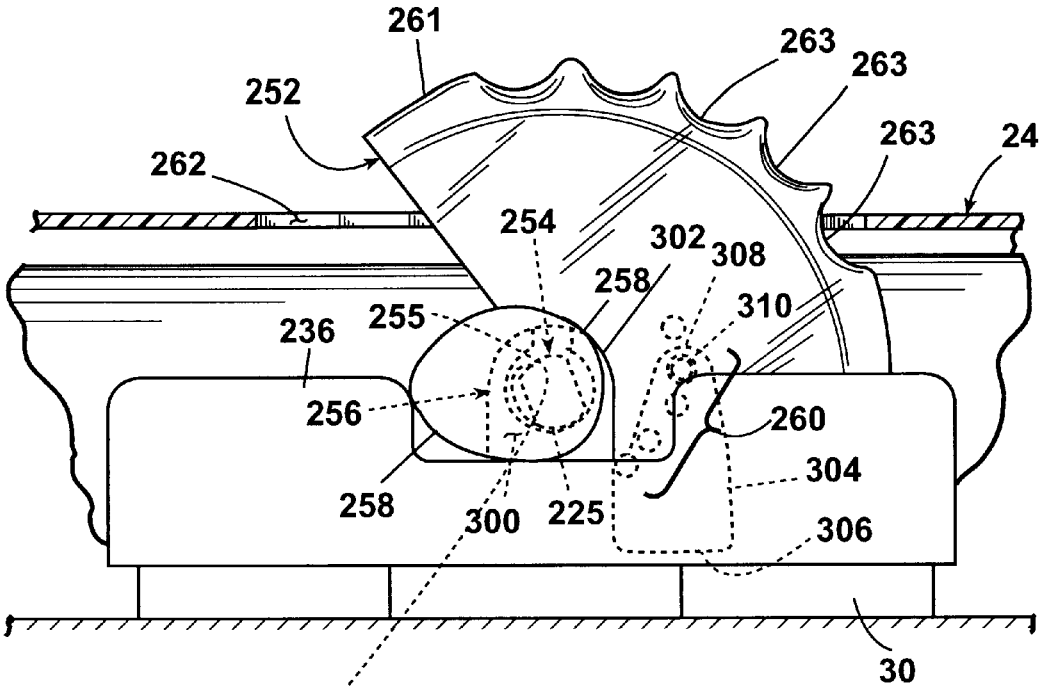
FIG. 8 is a rear elevational view of a height adjustment knob mounted to the base of the upright vacuum cleaner in abutment with the wheel housing of FIG. 6 and showing a detent mechanism retaining the height adjustment knob in a particular location relative to the wheel housing to maintain the base of the upright vacuum cleaner in a particular preselected position relative to a floor surface.
Figure 9:
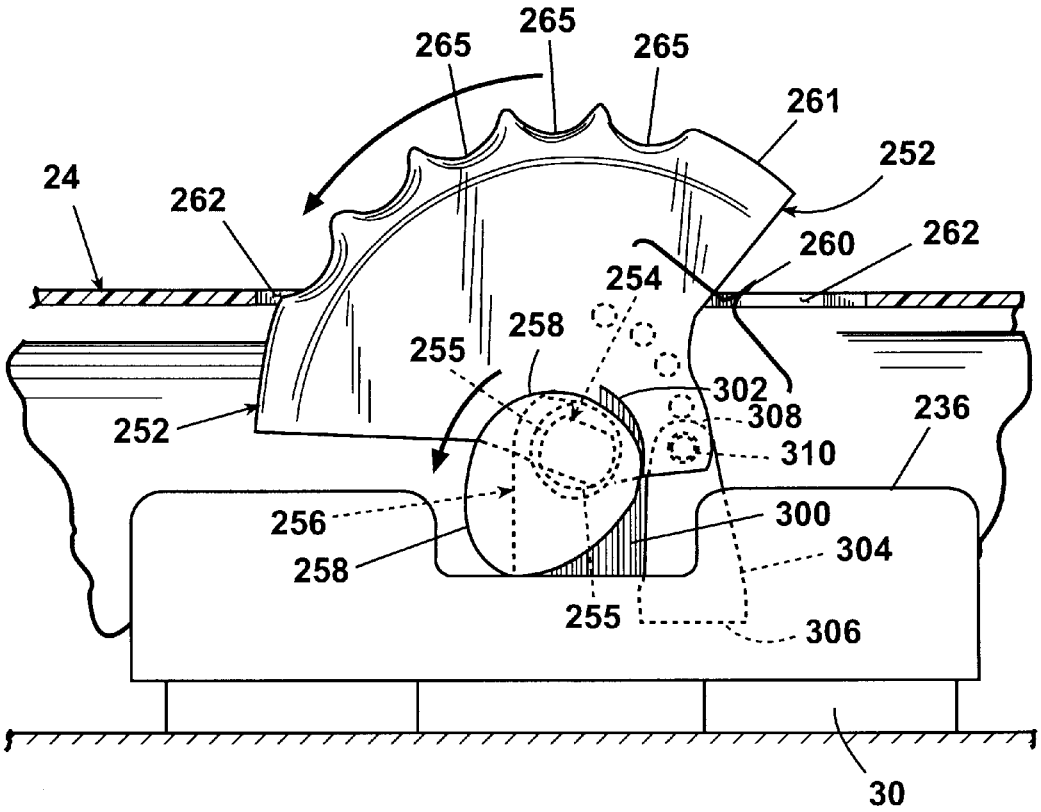
FIG. 9 is a view like FIG. 8 but showing the height adjustment knob in a different orientation.
Figure 10:
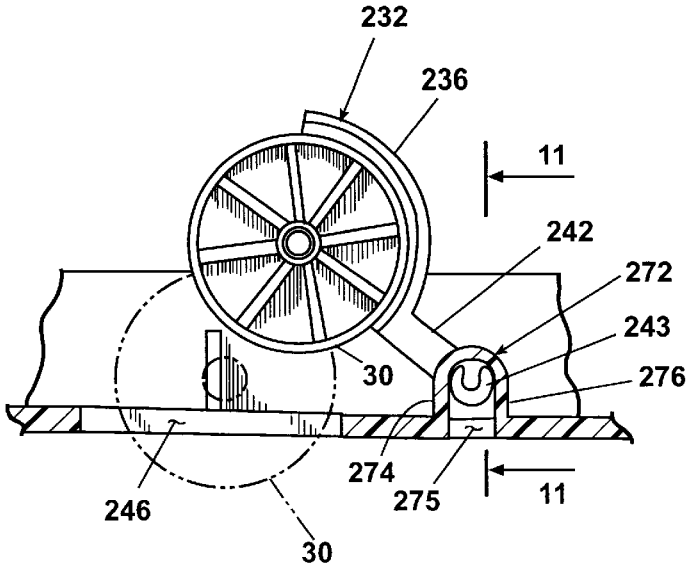
FIG. 10 is a cross-sectional view taken along lines 10—10 of FIG. 6, showing in solid lines the position of the height adjustment wheel housing during an installation process and showing the wheel housing in an operational position.

As shown in greater detail in FIGS. 8–9, the height adjustment mechanism comprises an actuator 252 comprising a sector-shaped thumb wheel having several detent recesses 260 provided in a spaced radial relationship on a forward surface thereof. Several rounded grip-enhancing indentations 263 are provided on an outward radial surface 261 thereof. The actuator 252 has a rearward surface with a rearwardly-extending shaft 254. The shaft 254 preferably has a generally rectangular cross-section provided with a pair of opposed arcuate surfaces 255 thereon. A smooth, elliptical eccentrically-mounted cam 258 is mounted to a rearward end of the shaft 254.

The base pan 26 preferably has a journal mounting 256 comprising an upwardly-extending arm having a slotted circular retainer 302 at an upper end thereof. A deflectable finger 304 is mounted to the base pan 26 in a cantilevered fashion at a lower end 306 thereof. An upper end 308 of the finger 304 has a detent 310 thereon which is adapted to be received in one of the detent recesses 260 on the actuator.

The actuator 252 is mounted to the base pan 26 by orienting the actuator 252 relative to the retainer 302 on the arm 300 so that the opposed arcuate surfaces 255 are aligned with the slotted retainer 302. One of the opposed arcuate surfaces 255 is urged into the slotted circular retainer 302 until the shaft 254 is fully received therein as shown in FIGS. 8–9. The actuator 252 is then rotated until the shaft 254 is journaled in the slotted circular retainer 302 whereby the opposed arcuate surfaces 255 bear against interior surfaces of the retainer 302. In its assembled state within the base pan 26, the indentations 263 on the outer radial surface 261 of the actuator 252 protrude through an aperture 262 on the cover 24 for access to the height adjustment mechanism 250 by the user.

At the opposite end of the shaft 254, the cam 258 bears against the central flange 240 of the wheel housing 232. One of the detent recesses 260 along the outer forward surface of the actuator 252 mates with the detent 310 on the finger 304 to hold the actuator 252 in one of several adjustment positions. Although the actuator 252 can be rotated while the handle assembly 16 is in the upright stored position, actual pivotable movement of the wheel housing can only occur when the handle assembly 16 is lowered into a rearwardly tilted use position.

As shown in FIG. 5 and in greater detail in FIGS. 8–9, when the handle assembly is lowered into an angular use position, the protrusion 248 on the motor housing 70 is rotated upwardly above the housing 232 and out of abutment with the housing 232. The weight of the vacuum cleaner 12 then rests in part on the lift wheels 30 urging them upwardly against the lower edge of the cam 258. As the actuator 252 is rotated by the user, the eccentric mounting of the cam 258 on the actuator 252 moves the lower edge of the cam 258 vertically with respect to the base pan 26 which, in turn, urges the housing 232 upwardly or downwardly as shown in the phantom outline of FIG. 5.

In addition, the rotation of the actuator 252 positions the detent 310 on the finger 310 into a next successive detent 260 on the forward surface of the actuator 252 to retain the lift wheels 30 at the new height. FIG. 8 shows the wheels 30 positioned in one of the detents 260 and FIG. 9 shows the actuator 252 maintaining the wheels at a new lowered height relative to the floor surface. As can be seen, the agitator brush 68 is thereby held at a raised position relative to the floor surface by the housing 232 position in FIG. 9 compared to the housing 232 position shown in FIG. 8.

Figure 12A:
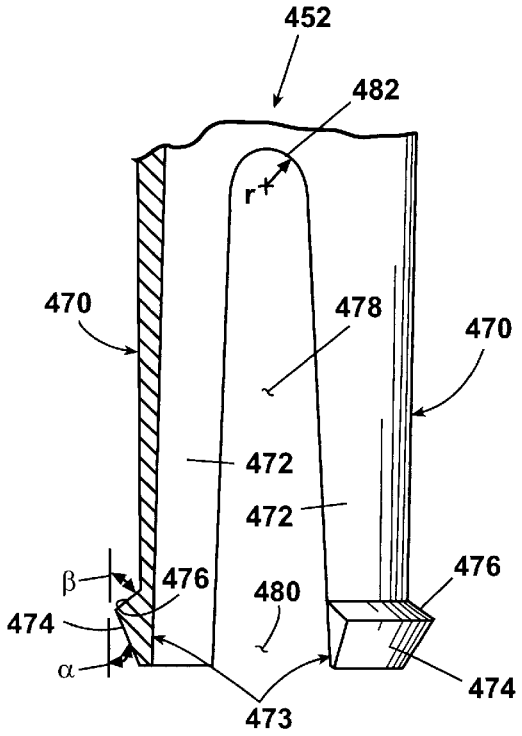
FIG. 12A is an enlarged fragmentary cross-sectional view of a detent portion of the height adjustment knob shown in FIG. 12.
Figure 12:
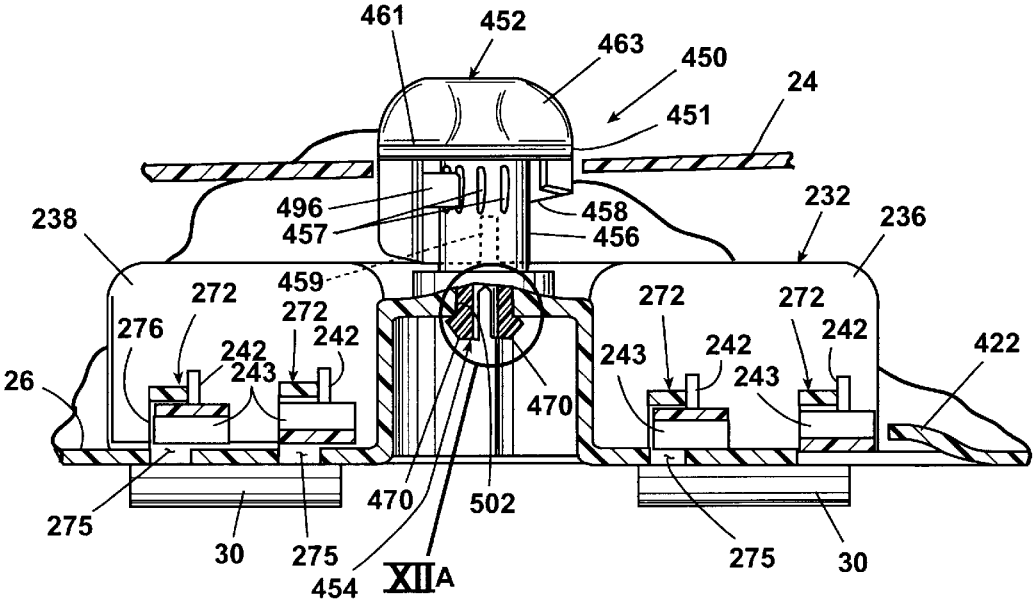
FIG. 12 is a fragmentary cross-sectional view of a second embodiment of the height adjustment mechanism for the upright vacuum cleaner of FIG. 1 according to the invention.
Figure 13:
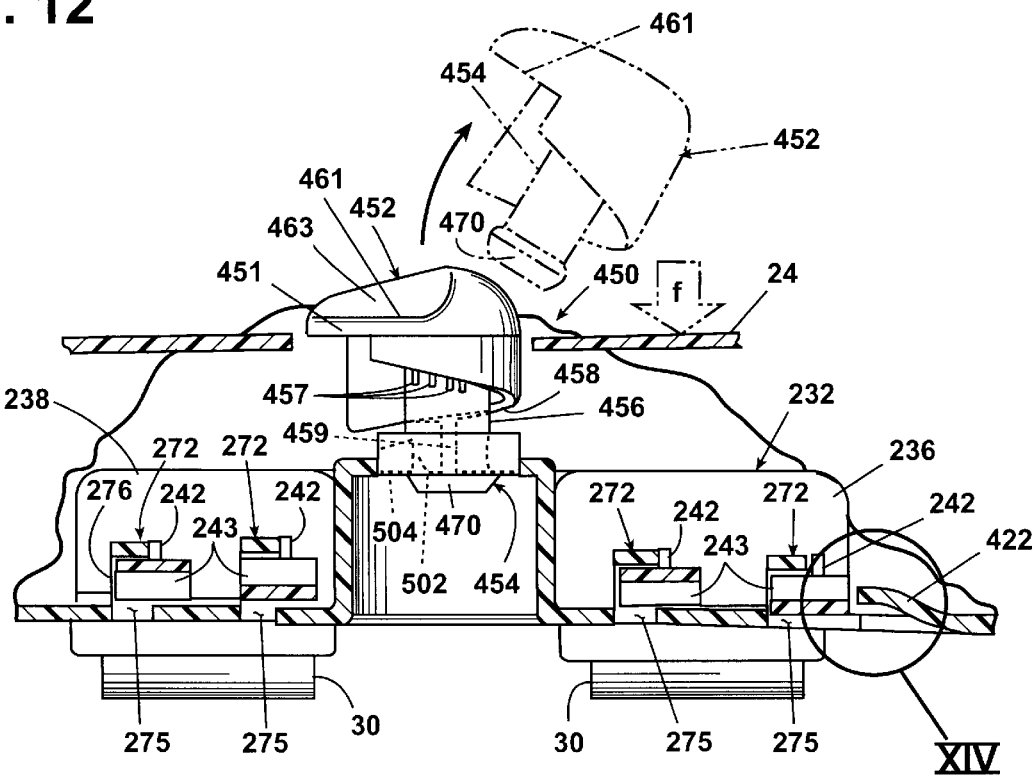
FIG. 13 is a fragmentary cross-sectional view like FIG. 12, except that the height adjustment knob has been rotated to a different discrete position and showing in phantom outline the release of the height adjustment knob upon a substantially large downward force applied an upper surface of a cover for the upright vacuum cleaner of FIG. 1.

Turning to FIGS. 12, 12A and 13, a second embodiment of a manual height adjustment mechanism 450 is shown. It will be further understood that the reference numerals used to describe portions of the vacuum cleaner 12 relative to the first embodiment of the height adjustment mechanism 250 are identical to common portions of the second embodiment of the height adjustment mechanism 450. The second embodiment of the height adjustment mechanism 450 is also effective only when the handle assembly 16 is located in a lowered floor cleaning mode. As described above, the protrusion 248 on the motor housing 70 lowers the lift assembly 230 to its fullest extent when the handle assembly 16 is located in the upright stored position.

As shown in greater detail in FIGS. 12–13, the height adjustment mechanism 450 comprises an actuator knob 452 having a shaft 454 depending therefrom in concentric alignment with the knob. This embodiment of the height adjustment mechanism is generally configured to be rotated about a generally vertical axis rather than the generally horizontal axis of rotation of the previous embodiment.

An outer edge 451 of the actuator 452 has a helical cam 458 which is concentrically aligned with the shaft 454 and depends from a lower surface of the actuator 452. A flexible detent finger 460 extends inwardly toward the shaft 454 from the cam 458 and is adapted to engage the base pan 26 to maintain the actuator 452 in a particular rotated position relative to the base pan 26 as will be described. A grip-enhancing handle 463 is on an upper surface 461 thereof.

The shaft 454 preferably is formed as a pair of depending spring arms 470 which are best shown in FIG. 12 and in greater detail in the enlarged lower portion of the spring arms 470 shown in FIG. 12A. Each of the spring arms depend from a lower surface of the actuator 452 and comprise an elongated resilient member having a specially-configured detent 473 at a lower end thereof. The detent 473 has a leading surface 474 and a trailing surface 476 which make angles with the vertical of $\alpha$ and $\beta$, respectively. The spring arms 472 are preferably spaced from one another by a gap 478, terminating at a lower open end 480 and an upper rounded surface 482 which has a radius of r. It has been found that the angle $\alpha$ can preferably be between 10 and 75 degrees with respect to vertical, and preferably about 25 degrees. The radius r can be selected based upon the material of the actuator and the angle $\alpha$ as well.

It has been found that the angle $\beta$ can preferably be between 10 and 90 degrees with respect to vertical, and preferably about 65 degrees with a sufficiently rigid material comprising the actuator 452 such as a rigid synthetic resin material. The radius r can be selected based upon the material of the actuator 452 and the angle $\beta$ as well.

As shown in a phantom outline of FIG. 13, upon the vacuum cleaner 12 encountering a sufficiently large downward force (shown graphically by arrow "F") which overcomes the removal force, the spring arms 470 are compressed by the effective upward force of the wheels 30 through the wheel housing 232 against the cam 458 of the actuator 452. The angle $\beta$ defines the point at which the coacting forces overcome the engagement of the trailing surfaces 476 of the detents 472 against the lower edge 504 of the central bore 502 of the bearing sleeve 456. Once the removal force is overcome, the spring arms 470 compress, the trailing surfaces 476 pass within the central bore 502 and the actuator is released from its rotatable mounting to the bearing sleeve 456 of the base pan 26. The actuator 452 can be re-mounted to the base pan 26 by re-inserting the shaft 454 of the actuator 452 within the central bore 502 of the bearing sleeve 456 as previously described.

The base pan 26 preferably has a bearing sleeve 456 having several grooves 457 located on an outer surface thereof adapted to be engaged by the finger 460 on the actuator 452. A central bore 502 is located vertically through the sleeve 456 which is adapted to receive the shaft 454 of the actuator 452. As will be described, angles $\alpha$ and $\beta$ and radius r of the spring arms 470 of the actuator 452 can be optimally selected to determine the insertion and removal force required to mount the shaft 454 of the actuator 452 within the central bore 502 of the bearing sleeve.

The actuator 452 is mounted to the base pan 26 by orienting the actuator 452 relative to the bearing sleeve 456 so that the shaft 454 is aligned with the central bore 502 of the bearing sleeve 456. The spring arms 470 of the shaft 454 are urged into the central bore 502 until the shaft 454 is fully received therein as shown in FIG. 12.

As the spring arms 470 are inserted within the central bore 502, the leading surfaces 474 thereof bearing against the interior surface of the central bore. Thus, the angle $\alpha$, radius r and size of the gap 478 can be selected to determine the amount of required insertion force. For example, the higher the angle $\alpha$, the more force required to insert the spring arms 470 into the central bore. Once the spring arms 470 have been fully inserted through the bore 502, the resiliency of the spring arms 470 causes them to spring back into their undeformed state and engage over a bottom edge 504 of the central bore 502. The actuator 452 can thereby be rotated relative to the bearing sleeve 456. When the actuator 452 is so mounted, the finger 460 can engage within one of the grooves 457 to retain the actuator 452 in a particular rotated position relative to the bearing sleeve 456.

At the lower end of the actuator 452, the cam 458 bears against an upwardly-extending flange 459 on the central flange 240 of the wheel housing 232. One of the grooves 457 along the outer surface of the bearing sleeve 456 mates with the finger 460 on the actuator 452 to hold the actuator 452 in one of several adjustment positions. Although the actuator 452 can be rotated while the handle assembly 16 is in the upright stored position, actual pivotal movement of the wheel housing can only occur when the handle assembly 16 is lowered into a rearwardly tilted use position.

When the handle assembly is lowered into an angular use position, the triangular protrusion 248 on the motor housing 70 is rotated upwardly above the housing 232 and out of abutment with the housing 232. The weight of the vacuum cleaner 12 then rests in part on the lift wheels 30, urging the housing 232 upwardly against the lower edge of the cam 458. As shown in FIGS. 12–13, as the actuator 452 is rotated by the user, the contact point between lower edge of the cam 458 on the actuator 452 and the flange 459 moves the lower edge of the cam 458 vertically with respect to the base pan 26 which, in turn, urges the housing 232 upwardly or downwardly by the abutment of the cam 458 against the flange 459 depending on the direction of rotation of the actuator 452.

In addition, the rotation of the actuator 452 positions the finger 460 on the actuator 452 into a next successive groove 457 on the outer surface of the bearing sleeve 456 to retain the lift wheels 30 at the new height. FIG. 12 shows the wheels 30 positioned in one of the grooves 457 and FIG. 13 shows the actuator 452 maintaining the wheels at a new lowered height relative to the floor surface after rotation to a new position. The agitator brush 68 is thereby held at a raised position relative to the floor surface by the new wheels 30 position in FIG. 13 compared to the wheels 30 position shown in FIG. 12.

The second embodiment of the height adjustment mechanism 450 also includes an inventive feature to prevent damage to the vacuum cleaner 12 due to an excessive downward force applied to the vacuum cleaner 12 during use such as when a user steps on an upper surface of the cover 24. Essentially, the configuration of the spring arms 470 on the actuator 452 is released from its rotatable mounting within the bearing sleeve when a downward force is encountered by the lift wheels. When this downward force exceeds a preselected removal force, the actuator is released, i.e., "pops off" the housing, rather than being damaged due to the downward force. The angle $\beta$ of the trailing surface 476 of each spring arm 470 defines the predetermined removal force in cooperation with the size of the gap 478 and the radius r just as the leading surface 474 defines the insertion force as described above.

The upright or lowered position of the handle assembly 16 is controlled by a foot pedal 264 which locks the handle assembly 16 in an upright position, releases the handle assembly 16 for movement to a 45-degree position at which the handle assembly 16 is locked, and then further releases the handle assembly 16 to permit rotation of the handle to an essentially horizontal position. The 45-degree position allows a user of any height to easily pivot the front of the nozzle over throw rugs and other obstacles which can be encountered during use. The foot pedal 264 is pivotably mounted to the base pan 26 of the vacuum cleaner 12 by an elliptical axle similar to pivot mounts 214 and is adapted to be received by a slotted circular retainer (not shown) similar to C-shaped sockets 220 on the base pan 26. Foot pedal 264 includes an integral arm spring 268 mounted adjacent to an exterior side of the foot pedal 264 to bias the foot pedal 264 in an upright position.

The foot pedal 264 is shown and described in much greater detail in a commonly-assigned U.S. Pat. No. 6,006,401 entitled "Vacuum Cleaner Having a Handle Release Thereon", filed Jan. 22, 1998 and incorporated herein by reference.

The motor housing 70, attached to the handle assembly 16 and rotatably mounted to the base pan 26, has first and second triangular protrusions 290 and 292 circumferentially disposed in a spaced relationship along a lateral radial portion of the motor housing 70 and which can register with a ridge 270 on the foot pedal 264.

Figure 2:
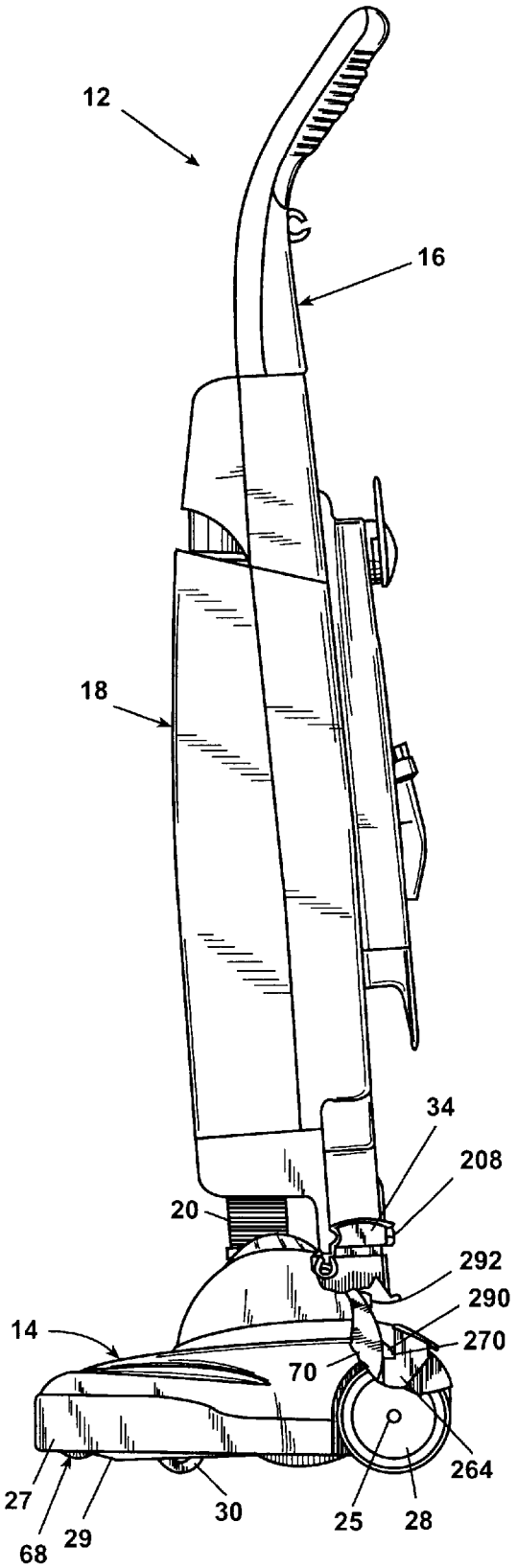
FIG. 2 is a side elevational view of the upright vacuum cleaner of FIG. 1.

The first protrusion 290 is a "hard" detent comprising a substantially right triangular flange extending from a rearward portion of the motor housing 70 adjacent the impeller end 102 as shown in the cut-out portion of FIG. 2. The second protrusion 292 is a "soft" detent comprising a gently-sloped substantially isosceles triangular flange spaced circumferentially upward from the first protrusion 290.

The first protrusion 290 retains the handle assembly 16 in a substantially vertical position, preferably about 5 degrees forward of vertical, and requires actuation of the foot pedal 264 to release the handle assembly 16 for rotation. The second protrusion 292 retains the handle assembly at approximately 45 degrees rearward of vertical and requires either actuation of the foot pedal 264 or slight manual downward pressure exerted on the nozzle 14 to release the handle assembly 16 for further downward rotation to a horizontal position.

Figure 11:
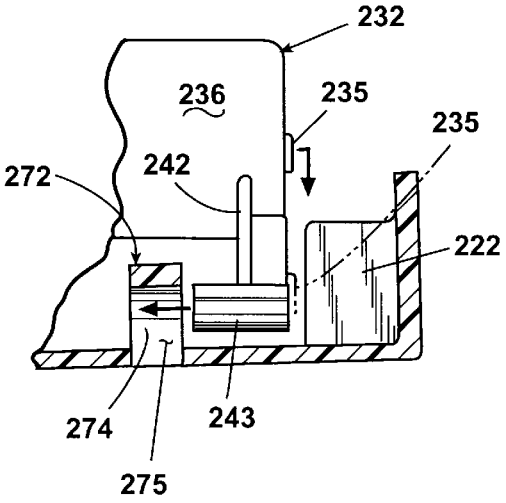
FIG. 11 is a fragmentary rear elevational view taken along lines 11—11 of FIG. 10.
Figure 14:
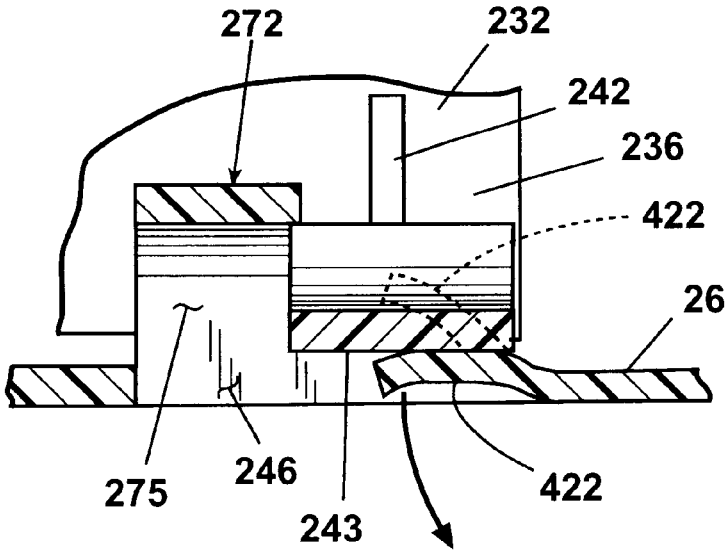
FIG. 14 is an enlarged fragmentary cross-sectional view of the area marked XIV of FIG. 13 and illustrating the insertion of the brackets on the wheel housing into the brackets on the base.

Turning to FIGS. 13–14, another embodiment of the stop member, shown as tab 222 in FIG. 11, is shown for preventing transverse movement of the housing 232 once it is pivotally mounted in the mounts 272 of the base pan 26. The second embodiment of the stop member is shown as resilient finger 422 mounted in cantilever fashion to an edge of one of the apertures 244 and 246. The finger 422 preferably has a ramped configuration, the function of which will now be described. The housing 232 is brought into alignment with the apertures 244, 246 so that the brackets 243 on the housing 232 are aligned with the interior portions 275 of the mounts 272. To bring the brackets 243 into alignment with the interior portions 275, the housing 232 must be pressed down upon the finger 422 so that the brackets 243 can be located on the rotational axis 245 with the interior portions 275.

Once the finger 422 is sufficiently compressed to allow the brackets 243 and interior portions 275 to be aligned on the axis 245, the housing 232 is slid transversely to locate the brackets 243 within the interior portions 275 of the mounts 272. One of the brackets 243 cams along the ramped surface of the finger 422 and urges the finger 422 downwardly, out of obstruction of the path of the bracket 243 into the interior portion 275 of the mount 276. The finger 422, once the brackets 243 are slid transversely a sufficient extent, clears the bracket 243 and springs back to its undeformed state.

The finger 422 preferably springs back a sufficient extent to prevent the brackets 243 from being slid transversely in the opposite direction to prevent accidental disengagement of the housing 232 from the base pan 26 due to the brackets 243 sliding transversely a sufficient extent to cause the brackets 243 to become removed from within the interior portions 275 of the mounts 272. Purposeful disengagement of the housing 232 from the base pan 26 can be effected by a user manually pressing downwardly on the finger 422 until the brackets 243 can be slid transversely out of the interior portions 275 of the mounts 272 and the housing 232 removed.

When the handle assembly 16 is to be rotated, foot pedal 264 is momentarily depressed which rotates it away from the motor housing 70 to release the ridge 270 on the foot pedal 264 from contact with the first protrusion 290 on the motor housing 70 to allow the handle assembly to freely rotate to a position defined by the second protrusion 292. The position of the protrusions 290 and 292 on the motor housing 70 are selected such that the handle position has three defined locations: a fully upright position approximately 5 degrees in front of vertical, an approximate 45-degree position used normally during operation of the vacuum and to lift the vacuum over a small obstruction and a substantially horizontal position for vacuuming under tables and the like. When the foot pedal 264 is released, the arm spring 268 urges the ridge 270 back into contact with the motor housing 70.

In operation, the handle assembly 16 on the upright vacuum cleaner 12 can be placed into a floor cleaning use position by actuating foot pedal 264 and lowering the handle assembly 16 into an approximate 45-degree position or any position intermediate the vertical and 45-degree position. The vacuum motor 69 can be actuated by momentarily depressing foot switch 34 activating the vacuum motor 69 so that the vacuum cleaner 12 can be rolled over the floor surface to be cleaned.

Depending upon the type of floor surface being cleaned, the thumb wheel 252 of the height adjustment mechanism 250 can be rotated clockwise or counterclockwise to raise or lower the housing 232 and, consequently, the agitator brush 68 and suction inlet 75 are repositioned at a particular desired height for optimal cleaning effectiveness. Once the foot switch 34 is actuated which supplies power to the motor 69, the agitator brush 68 is rotated at a high speed through the transmission of the rotation of the motor shaft 72 through the belt 74. Dust and other debris is loosened by the agitator brush 68 and suctioned into the working air conduit 76, expelled out of the outlet conduit 114, and into the vertical conduit in the handle assembly 16 such that it is trapped in a filter bag therein.

Alternatively, the hose 20 can be used to collect dust and debris when the handle assembly 16 is in the upright position as the conversion valve assembly 120 diverts the suction through the hose 20. When finished, the handle assembly 16 can be repositioned in the upright position as shown in FIG. 1 which automatically lifts the foot 14 from contact with the floor via lift mechanism 230 and turned off by again, momentarily depressing foot switch 34.

On occasion, the vacuum motor drive belt 74 wears thin and requires replacement. When it is desired to replace the belt 74, the sole plate 29 can be removed, which exposes an axially-extending channel 280 in the base pan 26 into which extends the motor shaft 72 and the forwardly-extending drive belt 74. The sole plate 29 can be removed by manually disengaging each flexible finger 56 from engagement with tabs on the base pan 26. Alternatively, threaded fasteners can be employed in place of, or in addition to, the flexible finger 56. The agitator brush 68 is rotatably mounted within an agitator chamber 66 provided in the base pan 26 and is retained at one end by a circular aperture in the base and at another end by a trunnion mount on the sole plate 29. The sole plate 29 has a flexible finger 56 with a retainer which snaps into an opening in the base pan 26. The belt 74 passes around the shaft 72 of the motor 69 and around a pulley on the agitator brush 68 such that rotation of the shaft 72 causes the belt 74 to impart rotary motion to the agitator brush 68. The removal of the sole plate 29 from the base pan 26 reveals the wide channel 280 along the longitudinal path of the vacuum motor drive belt 74 so that the channel 280 provides easy access for removal and replacement of the drive belt 74. To replace the belt 74, the agitator brush 68 is removed from the agitator chamber 66 in the base pan 26 and a new belt can be slipped over the shaft 72 in the channel 280 and over the belt-receiving area 138 of the agitator brush 68. The agitator brush 68 can then be moved forward into the agitator chamber 66 in the base pan 26 which stretches the belt 74 as it moves and provides the proper tension in the belt. The sole plate 29 is then remounted on the base pan 26 to retain the agitator brush 68 and permit the rearwardly-extending flange on the sole plate 29 to re-cover the belt 74 in the channel 280.

While the invention has been specifically described in connection with certain specific embodiments thereof, it is to be understood that this is by way of illustration and not of limitation, and the scope of the appended claims should be construed as broadly as the prior art will permit. Reasonable variation and modification are possible within the scope of the foregoing description of the invention without departing from the spirit of the invention which are defined in the appended claims.

What is claimed is:

1. In a vacuum cleaner comprising a foot, a handle pivotally mounted to the foot between a stored and a use position, a vacuum motor mounted to one of the handle and the foot, the foot having a suction inlet fluidly connected to the vacuum motor, an agitator brush rotatably mounted to the foot, a wheel assembly pivotally mounted to a forward portion of the foot for rotation about a transverse axis wherein the wheel assembly is adapted to rollably support the vacuum cleaner on a floor surface, the wheel assembly comprising a wheel housing, an axle mounted to the wheel housing and at least one wheel rotatably mounted to the axle, and a height adjustment mechanism mounted to the foot and operably connected to the wheel housing and adapted to move the wheel housing between a first and a second height positions relative to the foot thereby adjusting the position of the agitator brush relative to the floor, the improvement comprising:

(1) the wheel housing having at least one axle bracket extending therefrom along the transverse axis;

(2) at least one axle bracket-receiving socket formed in the foot, slidably receiving and pivotally mounting the at least one axle bracket;

whereby the wheel housing is pivotally mounted to the foot.

2. The vacuum cleaner of claim 1 wherein the at least one axle bracket is integrally formed with the wheel housing.

3. The vacuum cleaner of claim 2 wherein the at least one axle bracket is U-shaped in cross section.

4. The vacuum cleaner of claim 3 wherein the at least one axle bracket comprises a plurality of axle brackets.

5. The vacuum cleaner of claim 4 wherein the plurality of axle brackets comprises alternating upwardly-directed U-shaped members and downwardly-directed U-shaped members.

6. The vacuum cleaner of claim 5 wherein there is at least one axle bracket-receiving socket on the foot for each of the plurality of axle brackets.

7. The vacuum cleaner of claim 6 and further comprising a stop member mounted to the foot adjacent to the wheel housing to prevent lateral movement of the wheel housing with respect to the foot.

8. The vacuum cleaner of claim 7 wherein the stop member is aligned with the transverse axis to prevent lateral movement and withdrawal of the plurality of axle brackets with respect to the at least one axle bracket-receiving socket.

9. The vacuum cleaner of claim 8 wherein the stop member comprises a resilient finger mounted to the foot and movable between a first position wherein the finger obstructs the lateral movement of the plurality of axle brackets with respect to the at least one axle bracket-receiving socket and a second position wherein the lateral movement of at least one axle bracket with respect to the at least one socket is unobstructed by the finger whereby the wheel housing can be mounted to the foot only when the finger is located in the second position.

10. The vacuum cleaner of claim 7 wherein the wheel housing is movable between an install position and an operative position, wherein in the install position the plurality of axle brackets can be slidably moved with respect to the at least one socket and in the operative position the stop member is positioned to prevent lateral movement of the wheel housing with respect to the foot.

11. The vacuum cleaner of claim 6 wherein the wheel housing has an underside portion with a transverse groove, the transverse groove has at least one detent and receives the axle, wherein the detent retains the axle within the transverse groove.

12. The vacuum cleaner of claim 6 wherein the height adjustment mechanism comprises:

(1) an actuator movably mounted to the foot and adapted to be moved between a first setting and a second setting; and (2) a cam mounted to the actuator and in abutment with the wheel assembly so that movement imparted to the actuator is transmitted to the wheel assembly via the cam;

whereby movement of the actuator selectively positions the forward portion of the foot a preselected distance from the floor surface.

13. The vacuum cleaner of claim 12 wherein the cam has a radial edge which abuts the wheel assembly.

14. The vacuum cleaner of claim 13 wherein the actuator comprises a sector-shaped member rotatably mounted to the foot for movement about a horizontal axis.

15. The vacuum cleaner of claim 14 wherein the actuator has an outer radial surface which includes several shallow indentations thereon whereby the indentations aid a user in grasping the actuator for actuation thereof.

16. The vacuum cleaner of claim 15 wherein the height adjustment assembly further comprises a shaft having a first end mounted to the actuator and a second end mounted to the cam, the shaft having a generally rectangular cross section with a pair of opposed arcuate surfaces and a pair of opposed flat surfaces, the foot further comprises a retainer having a generally circular journal and a slot, the opposed arcuate surfaces are sized to rotate within the journal and the opposed flat surfaces are sized to fit within the slot for assembly of the shaft to the retainer.

17. The vacuum cleaner of claim 12 wherein the actuator has a bearing shaft, the foot comprises a bearing sleeve with a longitudinal bore which receives the bearing shaft for rotation about a longitudinal axis and a detent mechanism between the bearing shaft and the bearing sleeve to releasably mount the actuator to the foot.

18. The vacuum cleaner of claim 17 wherein the detent mechanism comprises at least one spring arm mounted to the bearing shaft and having a lateral shoulder which is received beneath a retaining surface of the foot.

19. The vacuum cleaner of claim 18 wherein the lateral shoulder has a leading surface extending outwardly from an end of the at least one spring arm at a first acute angle with respect to the longitudinal axis of the actuator to assist in installing the actuator in the foot and a retaining surface extending inwardly from an upper end of the leading surface at a second acute angle with respect to the longitudinal axis for releasable retention of the actuator in the foot.

20. The vacuum cleaner of claim 17 wherein the detent mechanism is constructed to retain the actuator to the foot under normal operating conditions and is adapted to release the actuator from the foot when a downward force of a predetermined magnitude is applied to the foot and an upward force is applied to the actuator.

21. The vacuum cleaner of claim 1 and further comprising a retainer pivotally mounted to the foot and having a movable ridge thereon, the handle having a first protrusion and a second protrusion in register with the ridge at different positions of the handle relative to the foot to releasably retain the handle at predetermined positions relative to the foot.

22. The vacuum cleaner of claim 21 wherein the retainer further comprises a spring arm biasing the movable ridge into contact with the handle.

23. The vacuum cleaner of claim 22 wherein the first protrusion comprises generally a right triangular shape.

24. The vacuum cleaner of claim 23 wherein the second protrusion is adapted to retain the handle at approximately a 45 degree angle with respect to vertical.

25. The vacuum cleaner of claim 1 wherein the at least one axle bracket is U-shaped in cross section.

26. The vacuum cleaner of claim 1 wherein the at least one axle bracket comprises a plurality of axle brackets.

27. The vacuum cleaner of claim 26 wherein the plurality of axle brackets comprises alternating upwardly-directed U-shaped members and downwardly-directed U-shaped members.

28. The improved vacuum cleaner of claim 26 wherein the axle bracket receiving socket is an inverted U-shape member and there is an axle bracket-receiving socket on the foot for each of the plurality of axle brackets.

29. The vacuum cleaner of claim 1 and further comprising a stop member mounted to the foot adjacent to the wheel housing to prevent lateral movement of the wheel housing with respect to the foot.

30. The vacuum cleaner of claim 29 wherein the stop member is aligned with the transverse axis to prevent lateral movement and withdrawal of the at least one axle bracket with respect to the at least one axle bracket-receiving socket.

31. The vacuum cleaner of claim 29 wherein the stop member comprises a resilient finger mounted to the foot and movable between a first position wherein the finger obstructs the lateral movement of the at least one axle bracket with respect to the at least one socket and a second position wherein lateral movement of at least one axle bracket with respect to the at least one socket is unobstructed by the finger whereby the wheel housing can be mounted to the foot only when the finger is located in the second position.

32. The vacuum cleaner of claim 29 wherein the wheel housing is movable between an install position and an operative position, wherein in the install position the at least one axle bracket can be slidably moved with respect to the at least one axle bracket-receiving socket and in the operative position the stop member is positioned to prevent lateral movement of the wheel housing with respect to the foot.

33. The vacuum cleaner of claim 1 wherein the wheel housing has an underside portion with a transverse groove, the transverse groove has at least one detent and receives the axle, wherein the detent retains the axle within the transverse groove.

34. The vacuum cleaner of claim 1 wherein the height adjustment assembly further comprises a shaft having a first end mounted to an actuator mounted to the foot and a second end mounted to a cam on the wheel housing, the shaft having a generally rectangular cross section with a pair of opposed arcuate surfaces and a pair of opposed flat surfaces, the foot further comprises a retainer having a generally circular journal and a slot, the opposed arcuate surfaces are sized to rotate within the journal and the opposed flat surfaces are sized to fit within the slot for assembly of the shaft to the retainer.

35. The vacuum cleaner of claim 1 wherein the height adjustment mechanism comprises an actuator having a bearing shaft, the foot comprises a bearing sleeve with a longitudinal bore which receives the bearing shaft for rotation about a longitudinal axis and a detent mechanism between the bearing shaft and the bearing sleeve to releasably mount the actuator to the foot.

36. The vacuum cleaner of claim 35 wherein the detent mechanism comprises at least one spring arm mounted to the bearing shaft and having a lateral shoulder which is received beneath a retaining surface of the foot.

37. The vacuum cleaner of claim 36 wherein the lateral shoulder has a leading surface extending outwardly from an end of the at least one spring arm at a first acute angle with respect to the longitudinal axis of the actuator to assist in installing the actuator in the foot and a retaining surface extending inwardly from an upper end of the leading surface at a second acute angle with respect to the longitudinal axis for releasable retention of the actuator in the foot.

38. The vacuum cleaner of claim 35 wherein the detent mechanism is constructed to retain the actuator to the foot under normal operating conditions and is adapted to release the actuator from the foot when a downward force of a predetermined magnitude is applied to the foot and an upward force is applied to the actuator.

39. The vacuum cleaner of claim 1 wherein the height adjustment mechanism comprises:

(1) an actuator movably mounted to the foot and adapted to be moved between a first setting and a second setting; and (2) a cam mounted to the actuator and in abutment with the wheel assembly so that movement imparted to the actuator is transmitted to the wheel assembly via the cam;

whereby movement of the actuator selectively positions the forward portion of the foot a preselected distance from the floor surface.

40. In a vacuum cleaner comprising a foot, a handle pivotally mounted to the foot between a stored and a use position, a vacuum motor mounted to one of the handle and the foot, the foot having a suction inlet fluidly connected to the vacuum motor, an agitator brush rotatably mounted to the foot, a wheel assembly pivotally mounted to a forward portion of the foot for rotation about a transverse axis wherein the wheel assembly is adapted to rollably support the vacuum cleaner on a floor surface, the wheel assembly comprising a wheel housing, an axle mounted to the wheel housing and at least one wheel rotatably mounted to the axle, and a height adjustment mechanism having an actuator movably mounted to the foot and adapted to be moved between a first setting and a second setting, a cam mounted to the actuator and in abutment with the wheel assembly so that movement imparted to the actuator is transmitted to the wheel assembly via the cam thereby adjusting the position of the agitator brush relative to the floor, the improvement comprising:

the actuator has a bearing shaft, the foot comprises a bearing sleeve with a longitudinal bore which receives the bearing shaft for rotation about a longitudinal axis and a detent mechanism between the bearing shaft and the bearing sleeve to releasably mount the actuator to the foot.

41. The vacuum cleaner of claim 40 wherein the detent mechanism comprises at least one spring arm mounted to the bearing shaft and having a lateral shoulder which is received beneath a retaining surface of the foot.

42. The vacuum cleaner of claim 41 wherein the lateral shoulder has a leading surface extending outwardly from an end of the at least one spring arm at a first acute angle with respect to the longitudinal axis of the actuator to assist in installing the actuator in the foot and a retaining surface extending inwardly from an upper end of the leading surface at a second acute angle with respect to the longitudinal axis for releasable retention of the actuator in the foot.

43. The vacuum cleaner of claim 42 wherein the detent mechanism is constructed to retain the actuator to the foot under normal operating conditions and is adapted to release the actuator from the foot when a downward force of a predetermined magnitude is applied to the foot and an upward force is applied to the actuator.

44. The vacuum cleaner of claim 40 wherein the detent mechanism is constructed to retain the actuator to the foot under normal operating conditions and is adapted to release the actuator from the foot when a downward force of a predetermined magnitude is applied to the foot and an upward force is applied to the actuator.

* * * * *